US012467196B2

(12) United States Patent
Lai

(10) Patent No.: US 12,467,196 B2
(45) Date of Patent: Nov. 11, 2025

(54) CLOTHING IRON

(71) Applicant: CONAIR LLC, Stamford, CT (US)

(72) Inventor: Kin Man Lai, Wu Kai Sha (HK)

(73) Assignee: Conair LLC, Stamford, CT (US)

( * ) Notice: Subject to any disclaimer, the term of this patent is extended or adjusted under 35 U.S.C. 154(b) by 67 days.

(21) Appl. No.: 18/478,310

(22) Filed: Sep. 29, 2023

(65) Prior Publication Data

US 2025/0109546 A1 Apr. 3, 2025

(51) Int. Cl.
*D06F 75/38* (2006.01)
*D06F 75/14* (2006.01)
*D06F 75/26* (2006.01)

(52) U.S. Cl.
CPC ..... *D06F 75/38* (2013.01); *D06F 75/14* (2013.01); *D06F 75/265* (2013.01)

(58) Field of Classification Search
CPC ..... D06F 75/38; D06F 75/14; D06F 75/265; D06F 75/20; D06F 75/30; D06F 75/36
See application file for complete search history.

(56) References Cited

U.S. PATENT DOCUMENTS 1,674,092 A * 6/1928 Brewer ..... D06F 75/20 38/77.6
1,995,035 A * 3/1935 Mcardle ..... D06F 75/38 38/88
2,637,126 A * 5/1953 Fitzsimmons ..... D06F 75/18 38/77.83
2,749,633 A 6/1956 Seck
3,403,463 A 10/1968 Stanley
3,690,024 A * 9/1972 Osrow ..... D06F 75/30 392/404
3,811,208 A * 5/1974 Vieceli ..... D06F 75/30 392/404
3,916,546 A * 11/1975 Bullock ..... D06F 81/00 38/1 B
5,937,552 A * 8/1999 Hall ..... D06F 75/38 38/93
D480,525 S 10/2003 Wendt
D544,165 S 6/2007 Massip
(Continued)

FOREIGN PATENT DOCUMENTS

EP 3 401 437 B1 2/2021
EP 3 396 056 B1 3/2021
(Continued)

OTHER PUBLICATIONS

Amazon.com_Rowenta Iron https://www.amazon.com/Rowenta-Stgainless-Soleplate-Microsteam-Auto-Off/dp/B07YFFNM92?source=ps-sl-shoppingads-lpcontext&ref_=fplfs&smid=ATVPDKIKXODER&th=1 (Year: 2020).

(Continued)

*Primary Examiner* — Ismael Izaguirre
(74) *Attorney, Agent, or Firm* — Ruggiero McAllister & McMahon LLC

(57) ABSTRACT

A clothing iron includes a soleplate having an edge wall extending from a horizontal plate. The edge wall extends around the entire perimeter of the horizontal plate. The edge wall is curved and has a fillet radius. The fillet radius varies around the perimeter of the horizontal plate. The soleplate has a front section and a back section. The edge wall at the front section has a fillet radius greater than a fillet radius at the back section.

19 Claims, 12 Drawing Sheets

(56) References Cited

U.S. PATENT DOCUMENTS

| | | | |
|---|---|---|---|
| D552,318 | S | 10/2007 | Leslie |
| D568,020 | S | 4/2008 | Poon |
| D645,629 | S | 9/2011 | Powell |
| D646,863 | S | 10/2011 | Hosoda |
| D654,240 | S | 2/2012 | Choi |
| D659,929 | S | 5/2012 | Yan |
| D668,413 | S | 10/2012 | Smith |
| D707,412 | S | 6/2014 | Renault |
| D708,410 | S | 7/2014 | Yamauchi |
| D712,109 | S | 8/2014 | Day |
| D715,012 | S | 10/2014 | Ringholm |
| D715,508 | S | 10/2014 | Ringholm |
| D734,582 | S | 7/2015 | Umeda |
| D764,734 | S | 8/2016 | Umeda |
| D773,144 | S | 11/2016 | Tan |
| D796,141 | S | 8/2017 | Miller |
| D796,764 | S | 9/2017 | Miller |
| D800,984 | S | 10/2017 | Müller |
| D803,502 | S | 11/2017 | Ho |
| D821,673 | S | 6/2018 | Bock |
| 10,358,764 | B2 | 7/2019 | Lukas |
| D905,922 | S | 12/2020 | Steiner |
| D939,171 | S | 12/2021 | Zheng |
| 2017/0241069 | A1 | 8/2017 | Curien |

FOREIGN PATENT DOCUMENTS

| | | | | |
|---|---|---|---|---|
| GB | 6351048 | | 3/2024 | |
| JP | 3626428 | B2 | 12/2004 | |
| WO | WO-2010023141 | A1 * | 3/2010 | ..... D06F 75/38 |

OTHER PUBLICATIONS

Amazon.com_Conair GlideLite Professional Iron https://www.amazon.com/Conair-GlideLite-Professional-Technology-Friction-Free/dp/B0CC6CD1T1/ref=sr_1_5 (Year: 2023).

* cited by examiner

CLOTHING IRON

BACKGROUND

1. Field of the Invention

The present disclosure is related to clothing irons. More particularly, the present disclosure is related to a clothing iron having a soleplate with a curved edge.

2. Description of Related Art

Clothing irons have a soleplate on a bottom portion that is heated to contact fabric to reduce wrinkles or form seams. Conventional clothing irons have soleplates that have a thin, flat front end. This thin, flat front end of conventional soleplates leads to undesirable snagging on collars, pockets, seams and buttons during use of the clothing iron. Further, the traditional soleplate has an integrated steam generating path that is formed from a one-piece die-cast. In addition, existing iron boilers are big heavy die-cast boilers.

Accordingly, there is a need for a clothing iron that overcomes, alleviates, and/or mitigates one or more of the aforementioned and other deleterious effects of prior art clothing irons.

SUMMARY

A clothing iron having a soleplate with a curved edge is provided.

Advantageously, the clothing iron having the soleplate with the curved edge allows a user to freely iron in any direction without being trapped by collar, buttons or pockets.

A clothing iron is provided that includes a soleplate having an edge wall extending from a horizontal plate. The edge wall extends around the entire perimeter of the horizontal plate. The edge wall is curved and has a fillet radius. The fillet radius varies around the perimeter of the horizontal plate. The soleplate has a front section and a back section. The edge wall at the front section has a fillet radius greater than a fillet radius at the back section.

The above-described and other features and advantages of the present disclosure will be appreciated and understood by those skilled in the art from the following detailed description, drawings, and appended claims.

DETAILED DESCRIPTION

Figure 1:
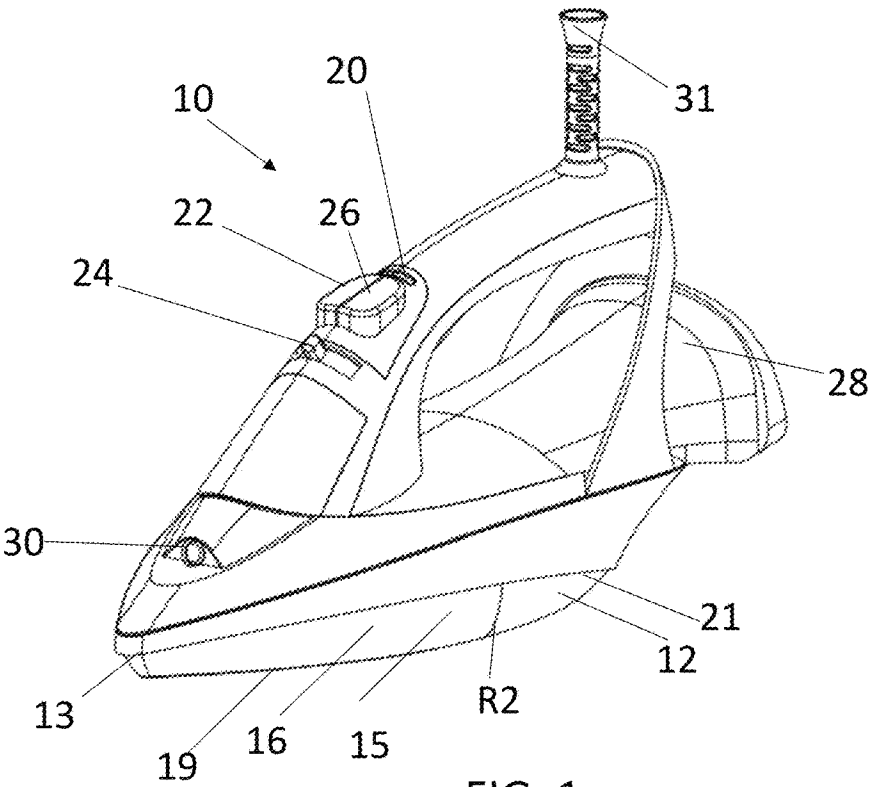
FIG. 1 is a front perspective view of a first embodiment of a clothing iron according to the present disclosure.

Referring to the drawings and in particular to FIG. 1, an exemplary embodiment of a clothing iron according to the present disclosure is shown and is generally referred to by reference numeral 10. Advantageously, clothing iron 10 has a soleplate 12 with a curved edge so that a user can freely iron in any direction without being trapped by collar, buttons or pockets. This curved edge design of soleplate 12 allows for smooth gliding on any area of a garment. Another advantage of clothing iron 10 is that soleplate 12 has a construction that applies sheet metal to form soleplate 12 and a steam boiler assembly 1200 (FIG. 12) that can be mounted on soleplate 12.

Figure 2:
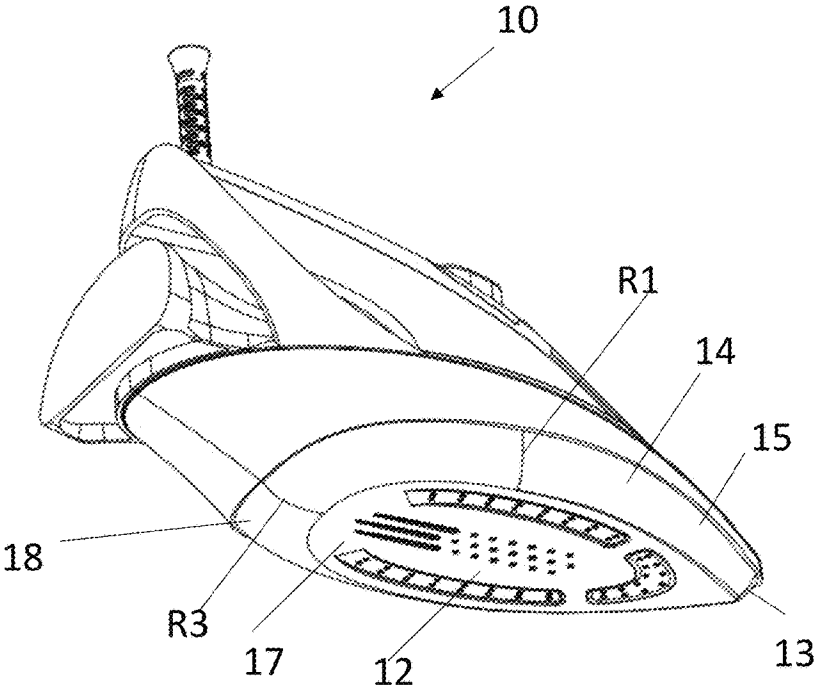
FIG. 2 is a rear perspective view of the clothing iron of FIG. 1.

Referring to FIGS. 1-11, clothing iron 10 heats soleplate 12 for ironing a garment. Referring to FIGS. 1 and 2, soleplate 12 has an edge wall 15 that extends from a horizontal plate 17. Edge wall 15 extends around the entire perimeter of horizontal plate 17. Edge wall 15 forms a left edge 14, a right edge 16 and a back edge 18. Left edge 14, right edge 16 and back edge 18 are rounded. Left edge 14 has a first fillet radius R1, right edge 16 has a second fillet radius R2 and back edge 18 has a third fillet radius R3. First fillet radius R1, second fillet radius R2 and third fillet radius R3 are each more than 3 millimeters ("mm"), preferably between 3 mm to 10 mm. The first fillet radius R1 of left edge 14, second fillet radius R2 of right edge 16 and third fillet radius R3 of back edge 18 can have varying radii edges so that first fillet radius R1, second fillet radius R2 and third fillet radius R3 are different. First fillet radius R1 can vary along left edge 14. Second fillet radius R2 can vary along right edge 16. Third fillet radius R3 can vary along back edge 18. First fillet radius R1 and second fillet radius R2 can form a radii edge of greater radius ranges toward a front section 19 of soleplate 12 relative to a rear section 21 of soleplate 12.

Figure 4:
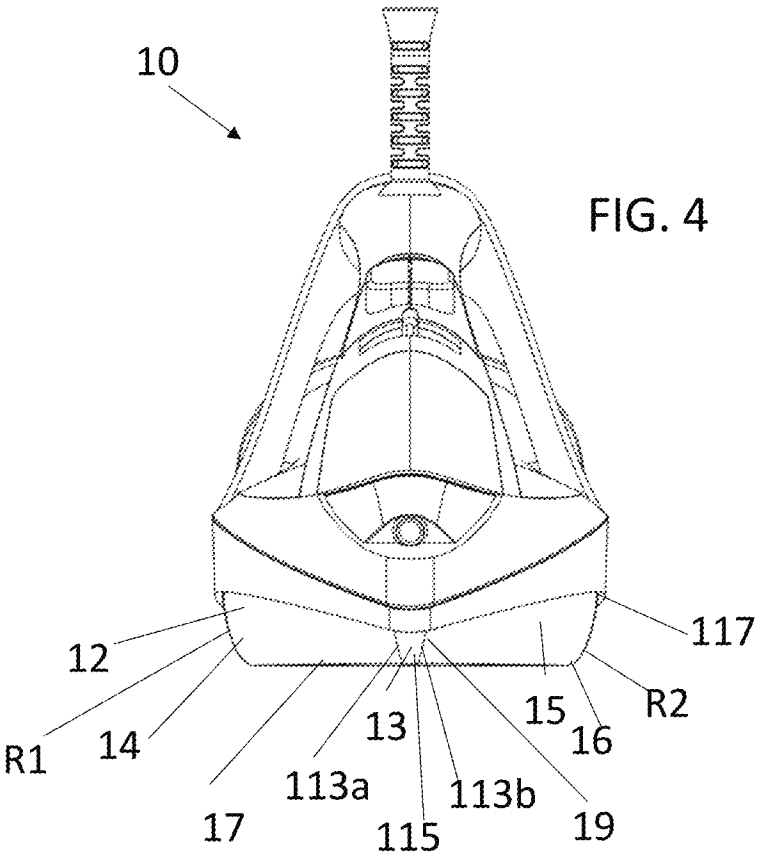
FIG. 4 is a front view of the clothing iron of FIG. 1.
Figure 3:
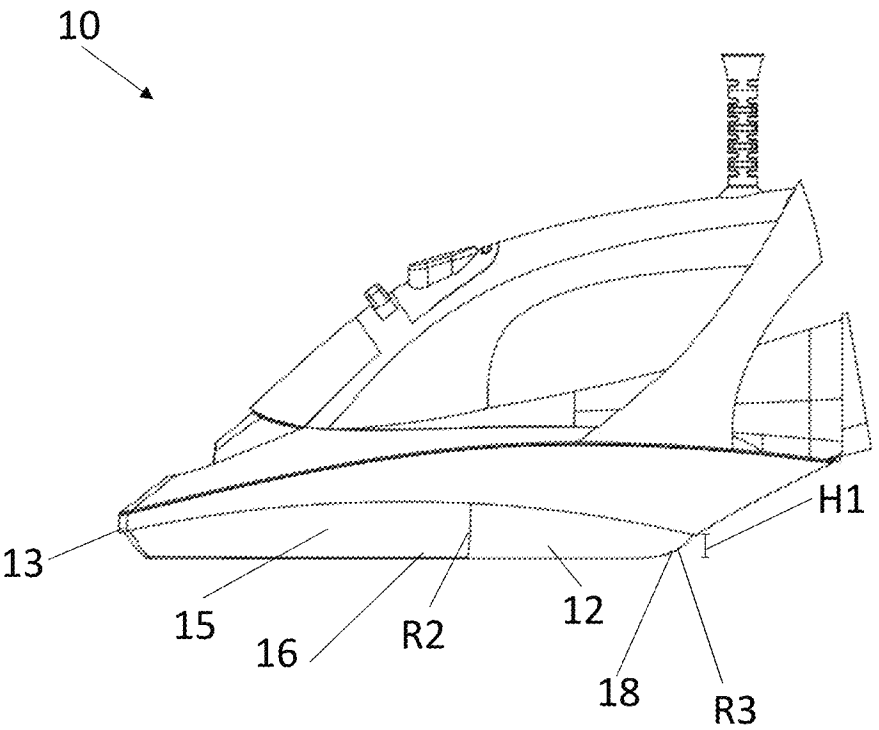
FIG. 3 is a side view of the clothing iron of FIG. 1.

Referring to FIG. 3, edge wall 15 has an edge height H1 of at least 6 mm, preferably, 6 mm to 100 mm, along left edge 14, right edge 16 and back edge 18. Edge height H1 can vary along each of left edge 14, right edge 16 and back edge 18. This edge height H1 of left edge 14, right edge 16 and back edge 18 is significantly different from traditional one piece die-cast soleplate irons. Accordingly, soleplate 12 has a "sharp corner" at a corner 13 with high walls and negative vertical angle (e.g. the angle of edge wall 15 to horizontal plate 17 is greater than 90 degrees if an inside angle is measured). As shown in FIG. 4, edge wall 15 forms a left seam 113*a* where corner 13 intersects with left edge 14 and a right seam 113*b* where right edge 16 intersects with corner 13. Edge wall 15 comprises an apex 115 at front section 19. Left edge 14 is adjacent to apex 115 and extends to back section 21. Right edge 16 is adjacent to apex 115 and extends to back section 21. Back edge 18 is located at back section 21 adjacent to and located between left edge 14 and right edge 16. Apex 115 forms a tip edge that is angularly offset from each of left edge 14 and right edge 16 so that left seam 113*a* separates the tip edge from left edge 14 that extends from soleplate 12 toward the top 117 of edge wall 15, and right seam 113*b* separates the tip edge from right edge 16 that extends from soleplate 12 toward the top 117 of edge wall 15. Corner 13 can push wrinkles away. Advantageously, soleplate 12 having left edge 14, right edge 16 and back edge 18 forms a front end geometry including corner 13, which is more like the bow of a ship cutting thought water, in contrast to a flat edge that can snag a button.

Figure 11:
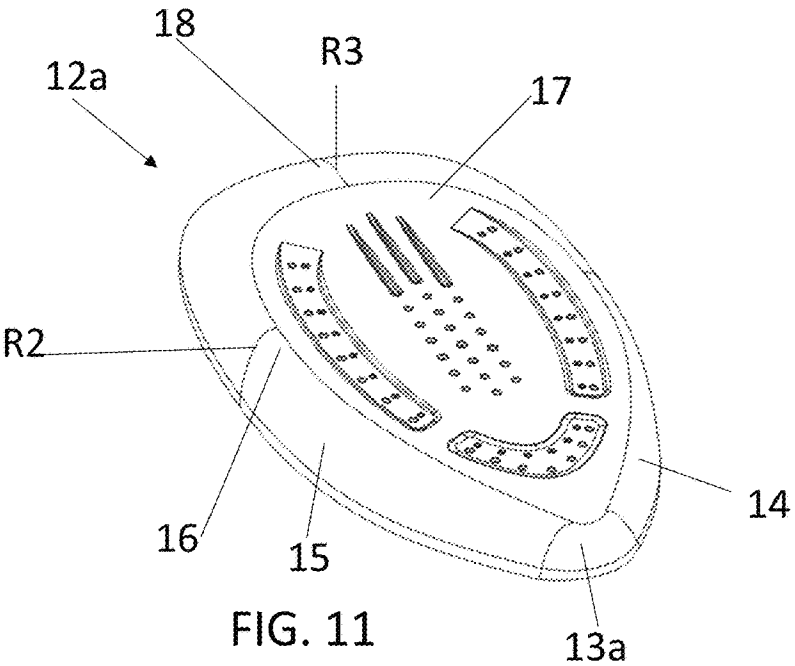
FIG. 11 is a top, front perspective view of the soleplate of FIG. 7 having a modified shape.
Figure 10:
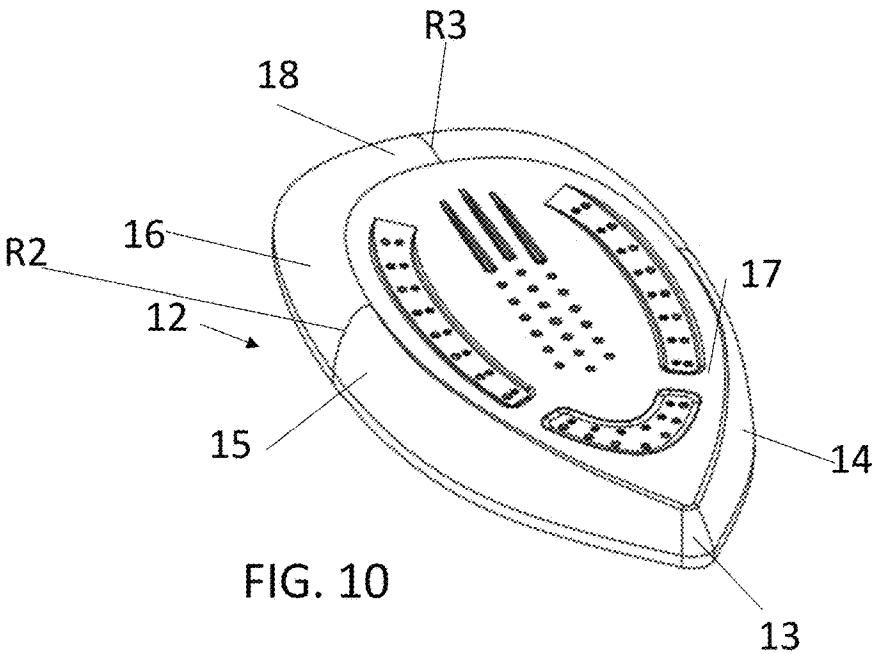
FIG. 10 is a top, front perspective view of the soleplate of FIG. 7.

Referring to FIG. 11, soleplate 12 can be modified to soleplate 12*a* that is the same as soleplate 12 except soleplate 12*a* has a corner 13*a* that is modified from corner 13 so that corner 13*a* is curved to be wider and more rounded than corner 13. Soleplate 12*a* has the same advantages as soleplate 12, and, in particular, neither soleplate 12 nor soleplate 12*a* is a flat edge that snags a button. Corner 13*a* allows for smooth gliding of clothing iron 10 on any area of the garment being ironed.

Advantageously, left edge 14, right edge 16 and back edge 18 of the soleplate are of a more rounded radius than typical clothing irons, and that they have a taller vertical height than the typical clothing irons. The radii profile of soleplates 12, 12*a* and the radii/corner curves of first fillet radius R1, second fillet radius R2 and third fillet radius R3 are much more gradual. These rounded radii of first fillet radius R1, second fillet radius R2 and third fillet radius R3 permit smooth passing over seams and no snagging on buttons.

Referring to FIG. 1, clothing iron 10 has soleplate 12, a temperature indicator 20, a water spray button 22, a steam dial 24, a steam burst button 26, a water tank 28, a nozzle spray 30 and a power cord 31 that is partially shown. Temperature indicator 20 can display a temperature of soleplate 12.

Figure 5:
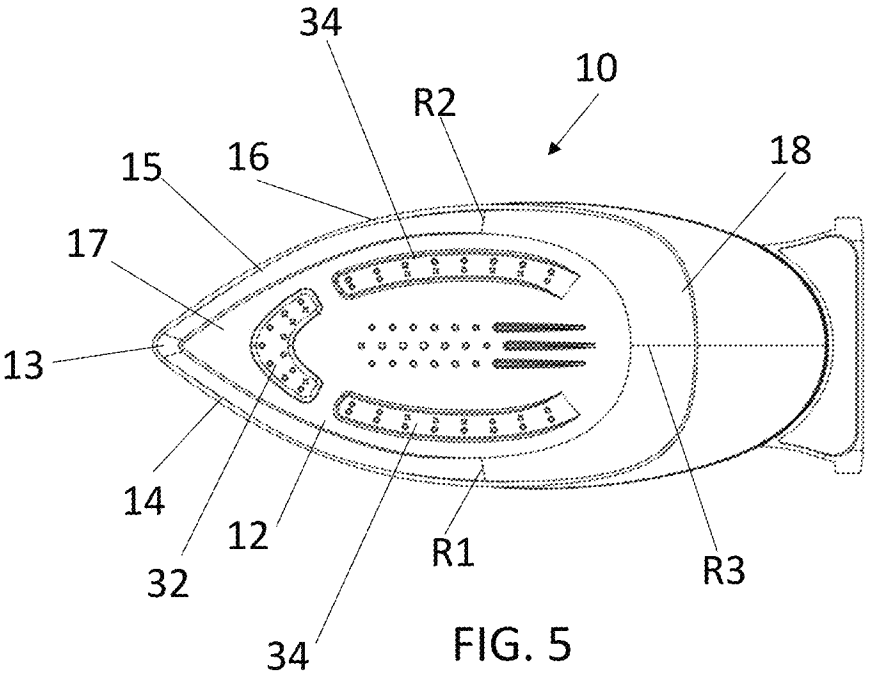
FIG. 5 is a bottom view of the clothing iron of FIG. 1.
Figure 7:
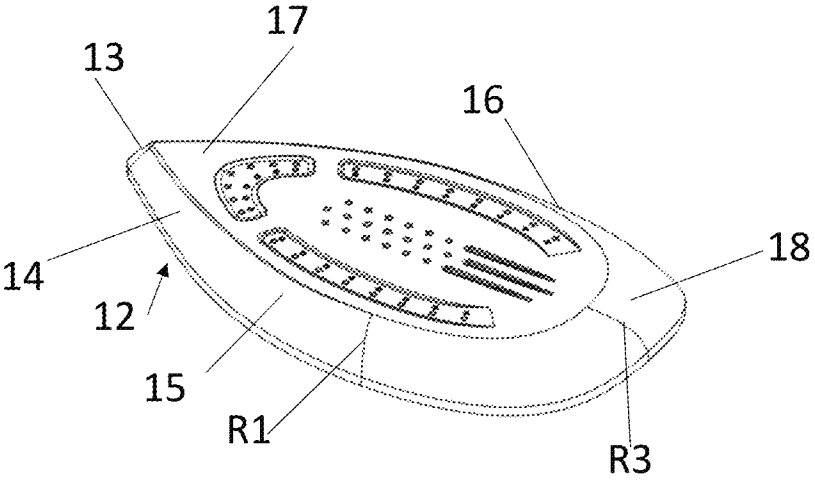
FIG. 7 is a top, rear perspective view of the soleplate that is inverted from FIG. 6.
Figure 6:
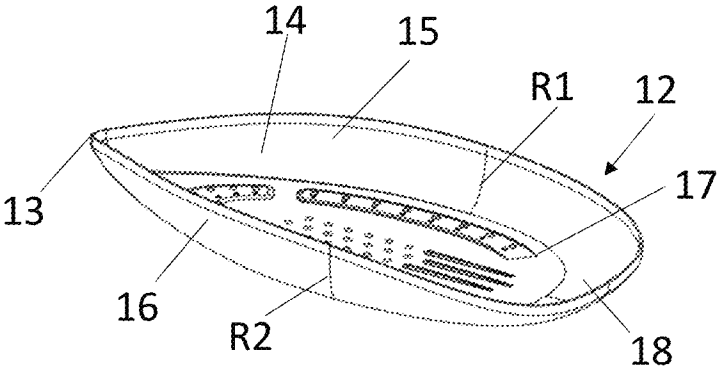
FIG. 6 is a top, rear perspective view of a soleplate of the clothing iron of FIG. 1.
Figure 9:
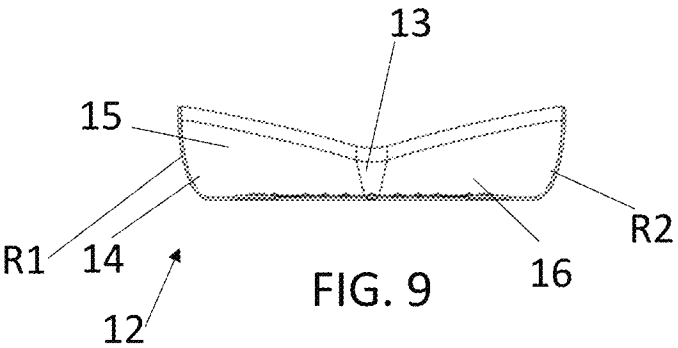
FIG. 9 is a front view of the soleplate of the clothing iron of FIG. 1.
Figure 8:
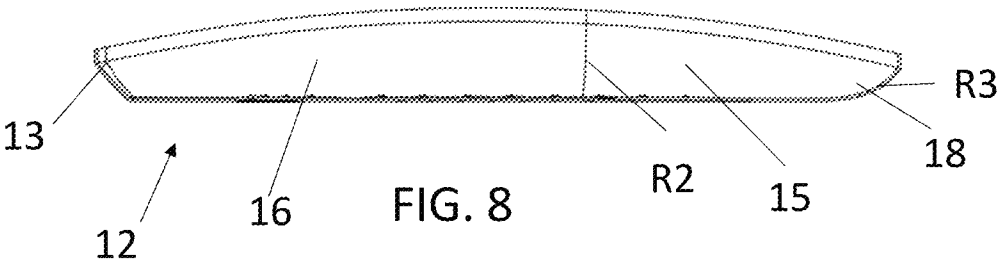
FIG. 8 is a right side view of the soleplate of the clothing iron of FIG. 1.

Referring to FIG. 5, soleplate 12 is a thin sheet metal iron soleplate that can have a soleplate burst steam outlet 32 having a plurality of holes and continuous steam outlets 34 each having a plurality of holes. Soleplate 12 can be a thin sheet metal soleplate with a light weight design. Soleplate 12 can be a thin sheet metal iron soleplate that is fabricated by drawing die set with a light weight design.

Figure 12:
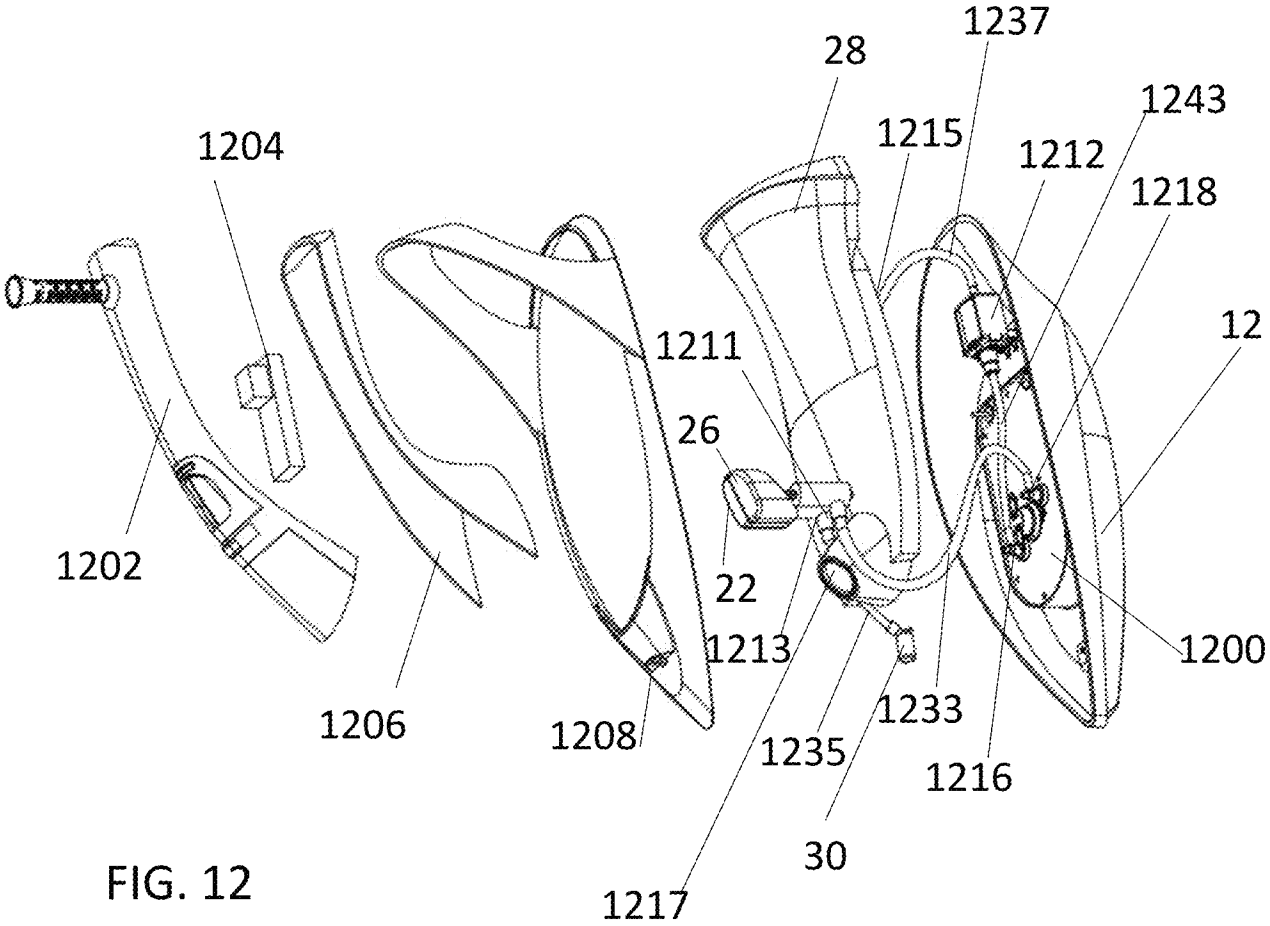
FIG. 12 is a front perspective exploded view of the clothing iron of FIG. 1.

Referring to FIG. 12, clothing iron 10 has soleplate 12, a hand cover assembly 1202, a printed circuit board ("PCB") 1204, a handle base 1206, an upper housing 1208, water tank 28, a fluid pump 1212, and steam boiler assembly 1200 that are connected when assembled. PCB 1204 can have a controller, for example, a microcontroller unit that controls operation of clothing iron 10. Water tank 28 receives water through a water inlet 1217.

Still referring to FIG. 12, water tank 28 has a first water tank outlet 1211, a second water outlet 1213 and a third water outlet 1215. Steam burst button 26 can open and close first water tank outlet 1211 either mechanically, for example, by a valve, or steam burst button 26 can provide input to the controller of PCB 1204 to activate and deactivate a structure to open and close first water tank outlet 1211. First water tank outlet 1211 is connected to a burst steam water inlet 1218 by tubing 1233. Water spray button 22 can open and close second water outlet 1213 either mechanically, for example, by a valve, or water spray button 22 can provide input to the controller of PCB 1204 to activate and deactivate a structure to open and close second water outlet 1213. Second water outlet 1213 is connected to nozzle spray 30 by tubing 1235. Third water outlet 1215 of water tank 28 is connected to fluid pump 1212 through by tubing 1237.

Figure 14:
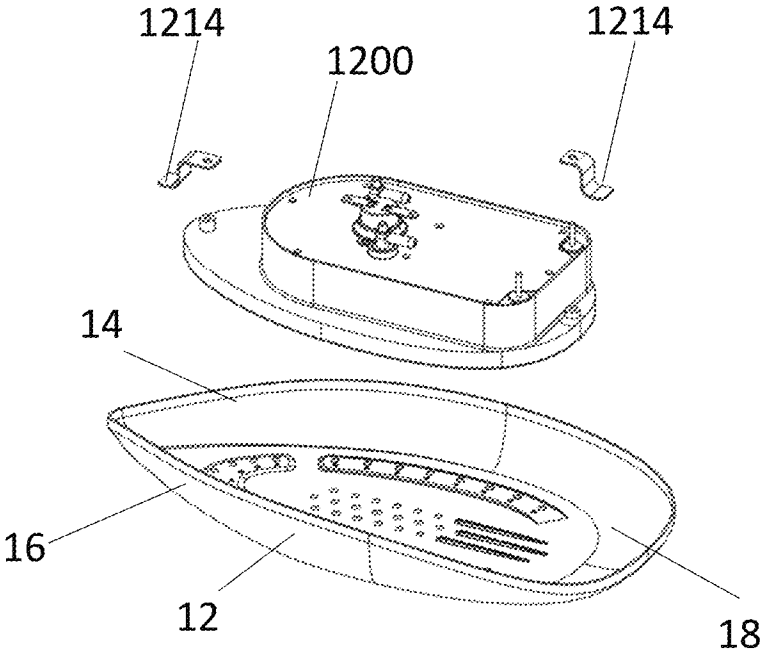
FIG. 14 is a top, rear exploded perspective view of the soleplate and the boiler assembly of FIG. 13.
Figure 13:
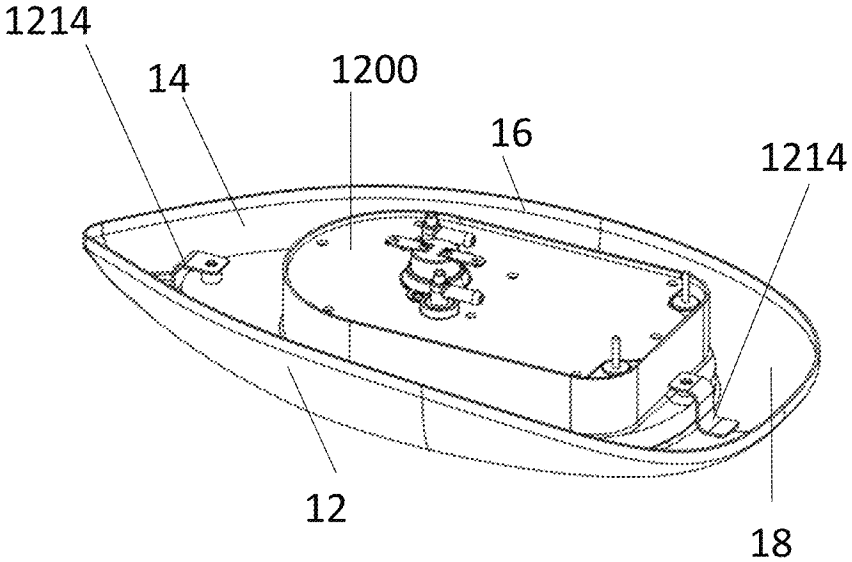
FIG. 13 is a top, rear perspective view of the soleplate of FIG. 6 connected to a boiler assembly.

Referring to FIGS. 13 and 14, steam boiler assembly 1200 can be connected to soleplate 12 by brackets 1214. Brackets 1214 are connected to both steam boiler assembly 1200 and soleplate 12 by fasteners, for example, screws, or welding, adhesive or other connector.

Figure 16:
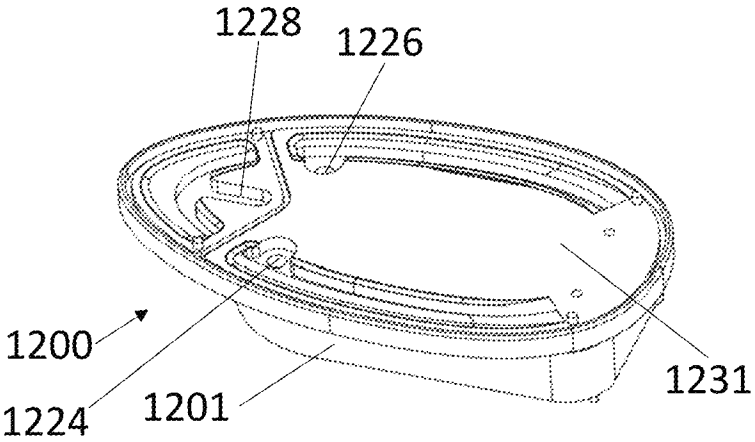
FIG. 16 is a top, rear perspective view of the boiler assembly of FIG. 13 inverted from FIG. 15.
Figure 15:
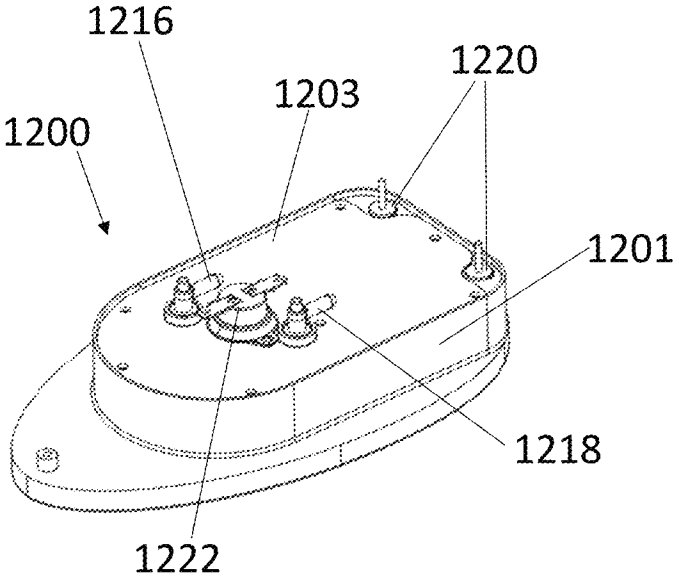
FIG. 15 is a top, front perspective view of the boiler assembly of FIG. 13.

Referring to FIG. 15, steam boiler assembly 1200 has a boiler 1201 and a cover 1203. Steam boiler assembly 1200 has a continuous steam water inlet 1216 and burst steam water inlet 1218 through cover 1203. Steam boiler assembly 1200 receives water through continuous steam water inlet 1216 and burst steam water inlet 1218. Steam boiler assembly 1200 further has a heater 1220 and thermostat 1222 through cover 1203. Referring to FIG. 16, steam boiler assembly 1200 has continuous steam outlets 1224, 1226 and a boiler burst steam outlet 1228 through boiler 1201.

Figure 17:
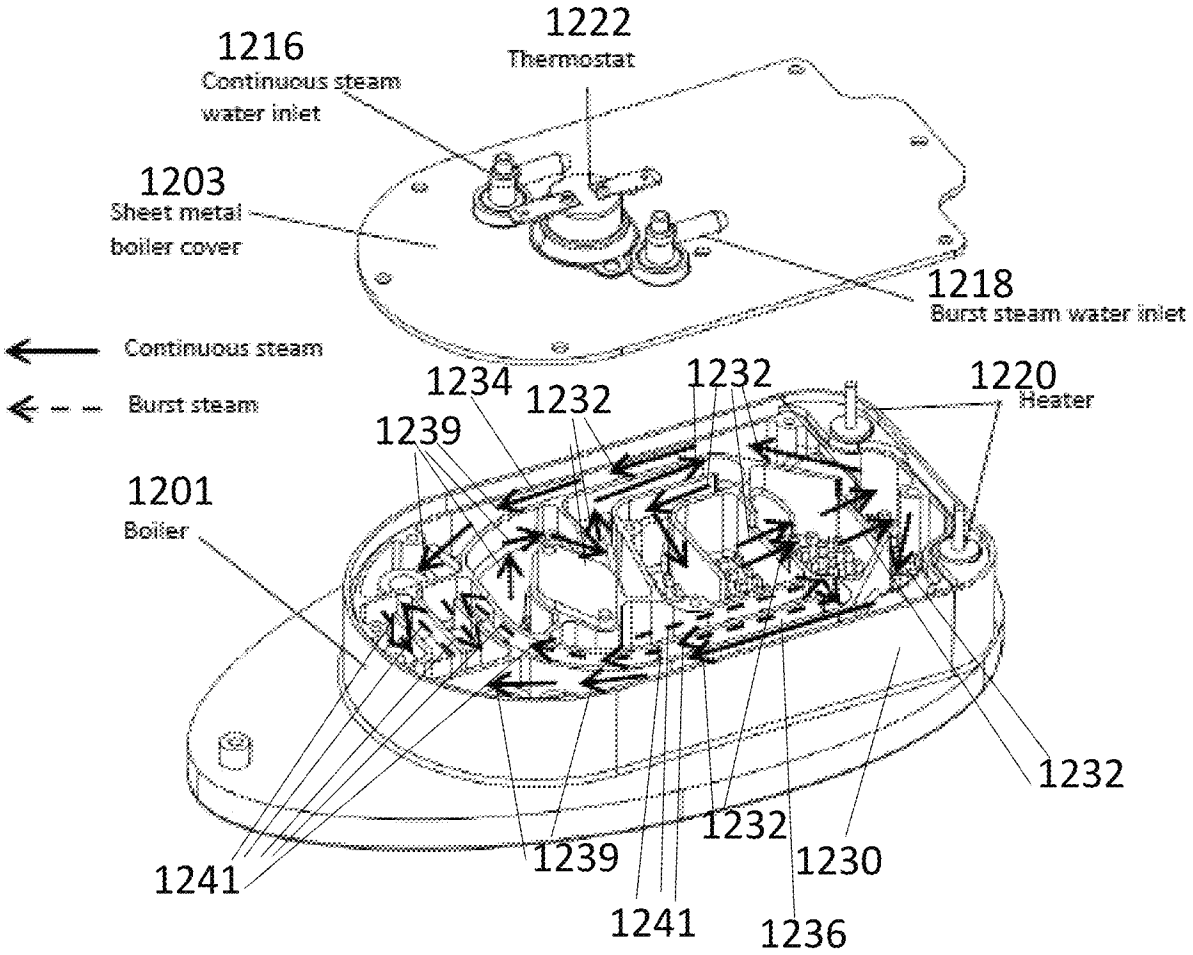
FIG. 17 is a top, front perspective view of the boiler assembly of FIG. 13 having a cover disconnected.
Figure 18:
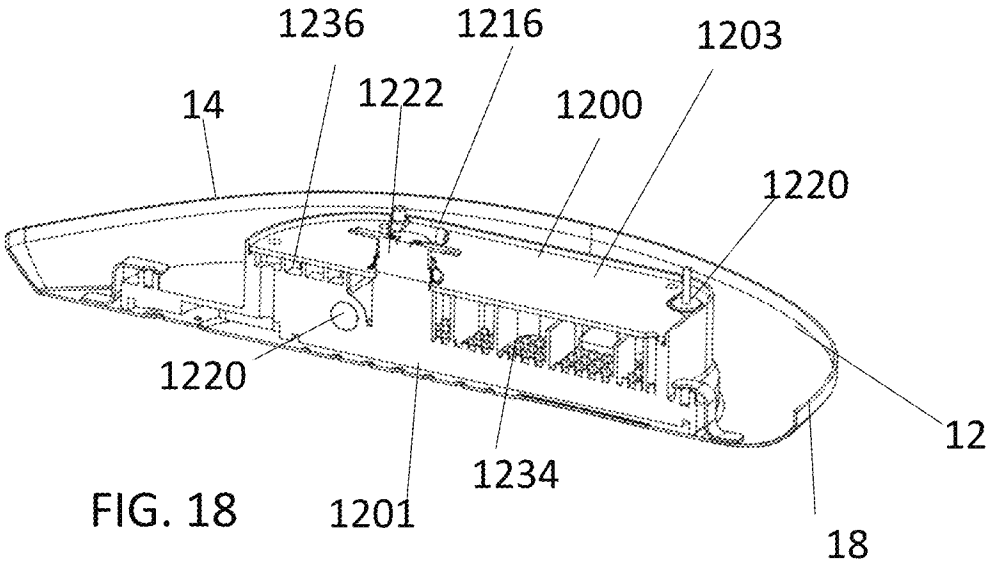
FIG. 18 is a top, rear cross-sectional perspective view of the soleplate and the boiler assembly of FIG. 13.

Referring to FIGS. 17 and 18, boiler assembly 1200 has cover 1203, a boiler side wall 1230, a boiler lower wall 1231 (FIG. 16) and interior walls 1232 that form a continuous steam path 1234 and a burst steam path 1236 so that boiler assembly 1200 has two steam chambers, one for continuous steam and the other for burst steam. Continuous steam path 1234 is shown by solid arrows 1239 and burst steam path 1236 is shown by arrows 1241 having broken lines. Continuous steam path 1234 is separated from burst steam path 1236.

During operation of clothing iron 10, a user connects power cord 31 to a power source to provide power to PCB 1204, fluid pump 1212 and/or heater 1220 during operation. Heater 1220 increases in temperature during operation. The temperature of heater 1220 is controlled by thermostat 1222 and/or the controller of PCB 1204. Fluid pump 1212 can operate to generate a flow of water from water tank 28 through third water outlet 1215, through tubing 1237, through fluid pump 1212, through tubing 1243, through continuous steam water inlet 1216 into continuous steam path 1234 of boiler assembly 1200. As shown by solid arrows 1239, water in continuous steam path 1234 that is heated by heater 1220 to form steam flows from continuous steam water inlet 1216 to continuous steam outlets 1224, 1226 and through continuous steam outlets 34 to contact fabric that is being ironed by the user. PCB 1204 can control fluid pump 1212 to provide water to continuous steam water inlet 1216 to continuously provide steam through continuous steam outlets 1224, 1226 during operation of clothing iron 10. Thus, fluid pump 1212 can draw water or fluid from water tank 28 to continuous steam path 1234 to generate continuous steam. Steam dial 24 can adjust an amount of steam through continuous steam outlets 1224, 1226, for example, by adjusting the speed of fluid pump 1212.

As shown by arrows with broken lines 1241, water in burst steam path 1236 that is heated by heater 1220 to form steam flows from burst steam water inlet 1218 to boiler burst steam outlet 1228. The user can selectively depress steam burst button 26 to open the valve allowing water to flow from water tank 28 through first water outlet 1211, through tubing 1233, through burst steam water inlet 1218 into burst steam path 1236 of boiler assembly 1200. As shown by arrows 1241 having broken lines, water in burst steam path 1236 that is heated by heater 1220 to form steam flows from burst steam water inlet 1218 to boiler burst steam outlet 1228 and through burst steam outlet 32 to contact fabric that is being ironed by the user to provide steam on demand during operation of clothing iron 10, for example, water and/or steam flows from water tank 28 to boiler burst steam outlet 1228 by gravity. When the user releases steam burst button 26, then the valve closes blocking water from flowing out of first water outlet 1211.

The user can selectively depress water spray button 22 to open the valve allowing water to flow from water tank 28 through second water outlet 1213, through tubing 1235, through nozzle spray 30 to provide a water spray on demand during operation of clothing iron 10. For example, water flows from water tank 28 to nozzle spray 30 by gravity. When the user releases water spray button 22, then the valve closes blocking water from flowing out of second water outlet 1213.

Alternatively, boiler assembly 1200 can be modified to have only one steam chamber without burst steam function. Another alternative is clothing iron 10 can omit fluid pump 1212 and the water can drip into continuous steam path 1234 by gravity.

Advantageously, boiler assembly 1200 is a small sized die-cast boiler that is light weight and with a high steam rate. Boiler assembly 1200 can be a small size die-cast boiler that is the same as a garment steamer that is light weight and with a high steam rate.

Figure 20:
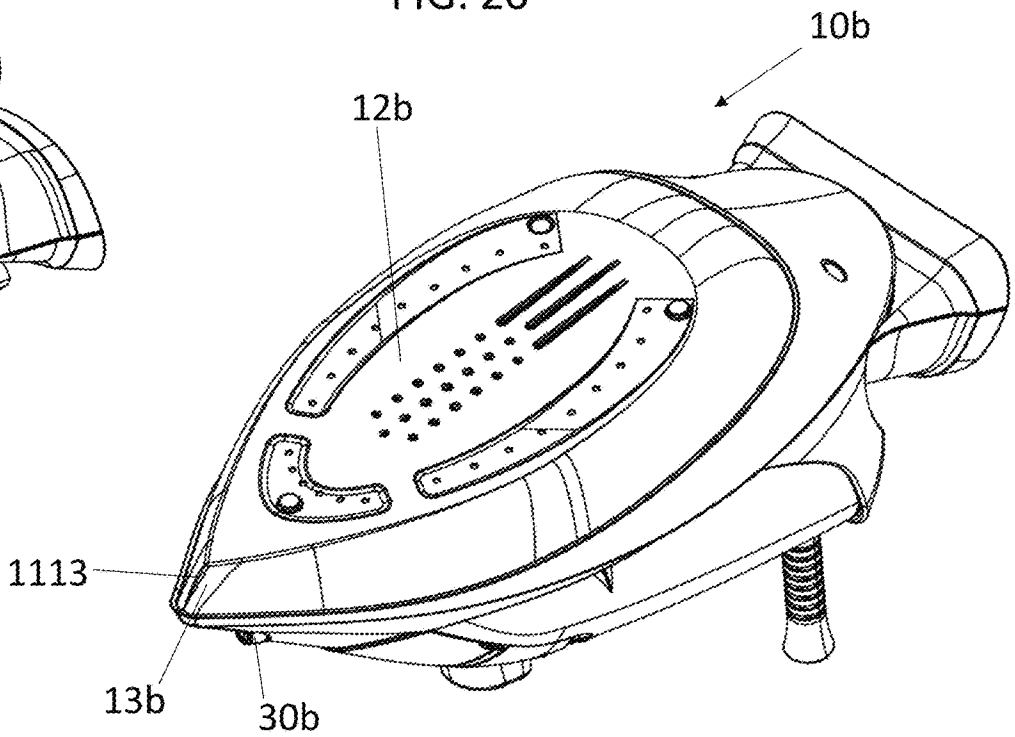
FIG. 20 is a front perspective view of the clothing iron of FIG. 19 that is inverted from FIG. 19.
Figure 19:
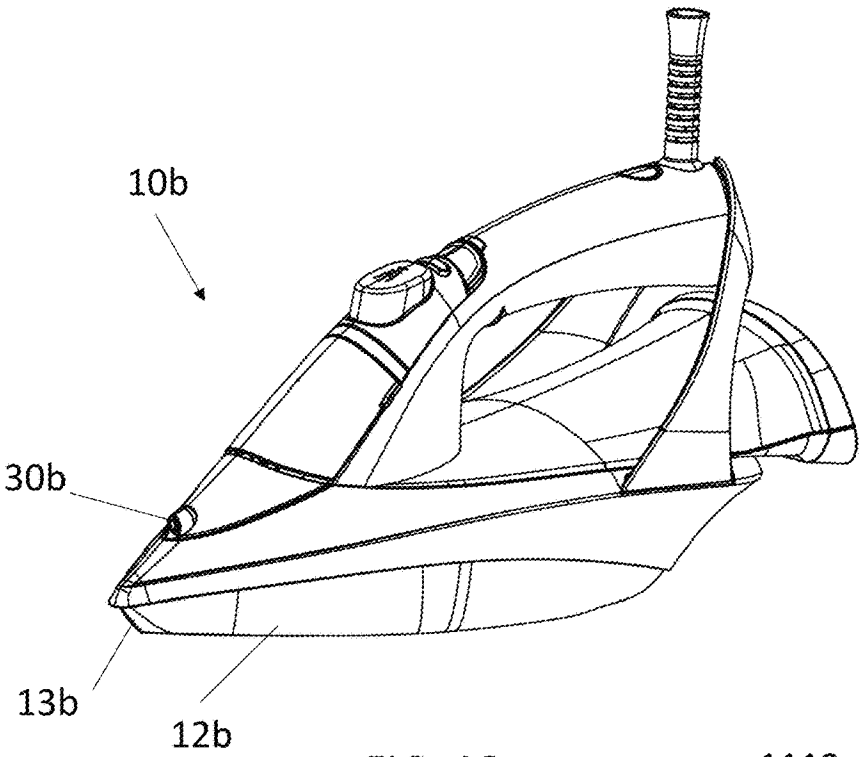
FIG. 19 is a front perspective view of another embodiment of a clothing iron of the present invention.

Referring to FIGS. 19 and 20, another embodiment of the present disclosure is directed to a clothing iron 10*b*. Clothing iron 10*b* is similar to clothing iron 10 of the first embodiment except the soleplate 12*b* has a different geometry in certain components. Also, clothing iron 10*b* has an elongated nozzle spray 30*b* of a different shape than nozzle spray 30 of the first embodiment. The corner 13*b* of soleplate 12*b* defines a sharp center ridge as compared to a flattened bevel defined by corner 13 in the first embodiment of soleplate 12. Corner 13*b* forms a single seam 1113 at the tip/point at the front of corner 13*b*.

While the present disclosure has been described with reference to one or more exemplary embodiments, it will be understood by those skilled in the art that various changes can be made and equivalents may be substituted for elements thereof without departing from the scope of the present disclosure. In addition, many modifications can be made to adapt a particular situation or material to the teachings of the disclosure without departing from the scope thereof. Therefore, it is intended that the present disclosure not be limited to the particular embodiment(s) disclosed as the best mode contemplated, but that the disclosure will include all embodiments falling within the scope of the appended claims.

What is claimed is:

1. A clothing iron comprising:

a soleplate having an edge wall extending from a horizontal plate, the edge wall extending around the entire perimeter of the horizontal plate, the edge wall being curved and having a fillet radius, the fillet radius varying around the perimeter of the horizontal plate, the soleplate having a front section and a back section, wherein the edge wall comprises an apex at the front section, a left edge adjacent to said apex and extending to said back section, a right edge adjacent to said apex and extending to said back section and a back edge located at said back section adjacent to and located between said left edge and said right edge, wherein each of said left edge and said right edge has an edge height of at least 6 mm adjacent the apex, and wherein the left edge has a first fillet radius, the right edge has a second fillet radius and the back edge has a third fillet radius that are each more than 3 mm.

2. The clothing iron of claim 1, wherein the edge wall has an edge height of at least 6 mm.

3. The clothing iron of claim 1, wherein said apex forms a single seam at the intersection of said left edge and said right edge, and wherein the single seam extends from said soleplate toward the top of said edge wall.

4. The clothing iron of claim 1, wherein the left edge has a first fillet radius, the right edge has a second fillet radius and the back edge has a third fillet radius that are each more than 3 mm.

5. The clothing iron of claim 4, wherein the first fillet radius, the second fillet radius and the third fillet radius are between 3 mm to 10 mm.

6. The clothing iron of claim 4, wherein the first fillet radius, the second fillet radius and the third fillet radius are varying radii edges so that the first fillet radius, the second fillet radius and the third fillet radius are different.

7. The clothing iron of claim 4, wherein the first fillet radius varies along the left edge.

8. The clothing iron of claim 4, wherein the second fillet radius varies along the right edge.

9. The clothing iron of claim 4, wherein the third fillet radius varies along the back edge.

10. The clothing iron of claim 4, wherein the first fillet radius and the second fillet radius form a radii edge of greater radius ranges toward the front section of the soleplate relative to the back section of the soleplate.

11. The clothing iron of claim 4, wherein the edge wall has an edge height of 6 mm to 100 mm, and the edge height varies along each of the left edge, the right edge and the back edge.

12. The clothing iron of claim 4, wherein the edge wall forms a curve at a corner where the left edge and the right edge intersect.

13. A clothing iron comprising:

a soleplate having an edge wall extending from a horizontal plate, the edge wall extending around the entire perimeter of the horizontal plate, the edge wall being curved and having a fillet radius, the fillet radius varying around the perimeter of the horizontal plate, the soleplate having a front section and a back section, wherein the edge wall at the front section has a fillet radius greater than a fillet radius at the back section, wherein said apex forms a tip edge that is angularly offset from each of said left edge and said right edge such that a left seam separating said tip edge from said left edge extends from said soleplate toward the top of said edge wall, and a right seam separating said tip edge from said right edge extends from said soleplate toward the top of said edge wall.

14. A clothing iron comprising:

a soleplate having an edge wall extending from a horizontal plate, the edge wall extending around the entire perimeter of the horizontal plate, the edge wall being curved and having a fillet radius, the fillet radius varying around the perimeter of the horizontal plate, the soleplate having a front section and a back section, wherein the edge wall at the front section has a fillet radius greater than a fillet radius at the back section, wherein the edge wall comprises an apex at the front section, a left edge adjacent to said apex and extending to said back section, a right edge adjacent to said apex and extending to said back section and a back edge located at said back section adjacent to and located between said left edge and said right edge, wherein the left edge has a first fillet radius, the right edge has a second fillet radius and the back edge has a third fillet radius that are each more than 3 mm, wherein the edge wall forms an angle with horizontal plate that is greater than 90 degrees.

15. A clothing iron comprising:

a soleplate being a sheet metal; and a steam boiler assembly connected to the soleplate, the steam boiler assembly having an inlet, a boiler, and an outlet, and the boiler forming a steam path, wherein the boiler has a boiler side wall, a boiler lower wall and interior walls, wherein the boiler is connected to a cover to form the steam path, and wherein the steam path is two steam paths that are a continuous steam path and a burst steam path so that boiler assembly has two steam chambers, one for continuous steam and the other for burst steam.

16. The clothing iron of claim 15, wherein the steam boiler assembly is connected to the soleplate by brackets.

17. The clothing iron of claim 15, wherein the inlet comprises two inlets that are a continuous steam water inlet and a burst steam water inlet each through the cover and a continuous steam outlet and a boiler burst steam outlet through the boiler.

18. The clothing iron of claim 17, wherein the continuous steam path receives water from a fluid pump that operates to generate a flow of water from a water tank, through first tubing, through the fluid pump, through second tubing, through the continuous steam water inlet into the continuous steam path of the boiler assembly.

19. The clothing iron of claim 17, wherein the burst steam path receives water from a water tank so that the water flows from the water tank, through third tubing, through the burst steam water inlet and into the burst steam path of the boiler assembly.

* * * * *